US010733915B2

(12) United States Patent
Yamada

(10) Patent No.: US 10,733,915 B2
(45) Date of Patent: Aug. 4, 2020

(54) PRINTING APPARATUS FOR PRINTING ON LABELS ON ROLL PAPER AND METHOD FOR DETECTING NUMBER OF REMAINING LABELS ON ROLL PAPER

(71) Applicant: SEIKO EPSON CORPORATION, Tokyo (JP)

(72) Inventor: Koji Yamada, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/356,532

(22) Filed: Mar. 18, 2019

(65) Prior Publication Data

US 2019/0287431 A1 Sep. 19, 2019

(30) Foreign Application Priority Data

Mar. 19, 2018 (JP) ..... 2018-050569

(51) Int. Cl.

| | |
|---|---|
| ***G09F 3/10*** | (2006.01) |
| ***B31D 1/02*** | (2006.01) |
| ***B41J 11/42*** | (2006.01) |
| ***B41J 11/00*** | (2006.01) |
| ***B41J 3/407*** | (2006.01) |

(52) U.S. Cl.

CPC ..... *G09F 3/10* (2013.01); *B31D 1/021* (2013.01); *B41J 3/4075* (2013.01); *B41J 11/0075* (2013.01); *B41J 11/0095* (2013.01); *B41J 11/42* (2013.01); *B31D 2201/02* (2013.01)

(58) Field of Classification Search

CPC .... B65C 9/40; B65C 9/42; B65C 9/44; B65C 2009/401; B65C 2009/402; B65C 2009/404; B65C 2009/405; B65C 2009/407; B41J 11/0075; B41J 11/0095; B41J 11/42; B41J 3/4075; G09F 3/10; B31D 1/021; B31D 2201/02

USPC ..... 156/DIG. 40, 42, 44, 46

See application file for complete search history.

(56) References Cited

U.S. PATENT DOCUMENTS

2015/0274346 A1* 10/2015 Buckby ..... B65C 9/1865 156/64

FOREIGN PATENT DOCUMENTS

JP 2013-212622 A 10/2013

* cited by examiner

*Primary Examiner* — George R Koch

(74) *Attorney, Agent, or Firm* — Foley & Lardner LLP

(57) ABSTRACT

In a printing apparatus for performing printing on labels of roll paper formed by winding a label sheet with the labels peelably attached to the label sheet, a label remaining number detecting unit, during a printing operation, determines a thickness of the label sheet from a length between the labels included in the label sheet fed out from a label sheet feed-out unit to a printing unit, the length being determined by a label length detecting unit while a distance to a cylindrical outer surface of the roll paper detected by a distance sensor.

5 Claims, 8 Drawing Sheets

$$Sx0 = \pi \cdot (D0/2)^2 - \pi \cdot (Ded/2)^2$$
$$= L_LBL \cdot td \cdot R_LBL$$
$$\Downarrow$$
$$R_LBL = (\pi \cdot (D0/2)^2 - \pi \cdot (Ded/2)^2) / (L_LBL \cdot td)$$

$$\Delta S = \pi \cdot (D0/2)^2 - \pi \cdot (Dx/2)^2$$
$$= L_LBL \cdot t \cdot C_LBL$$
$$\Downarrow$$
$$t = (\pi \cdot (D0/2)^2 - \pi \cdot (Dx/2)^2) / (L_LBL \cdot C_LBL)$$

$$Sx = \pi \cdot (Dx/2)^2 - \pi \cdot (Ded/2)^2$$
$$= L_LBL \cdot t \cdot R_LBL$$

$$\Downarrow$$

$$R_LBL = (\pi \cdot (Dx/2)^2 - \pi \cdot (Ded/2)^2) / (L_LBL \cdot t)$$

[NUMBER OF REMAINING 4-INCH LABELS (NEW (6-INCH DIAMETER) SET)

| | SYMBOL | DEFAULT/ USER | AT TIME OF STARTING | DURING PRINTING OPERATION | | | | | | | | | | | |
|---|---|---|---|---|---|---|---|---|---|---|---|---|---|---|---|
| NUMBER OF TIMES OF OBTAINMENT | N | – | 1 | 2 | 3 | 4 | 5 | 6 | 7 | 8 | 9 | 10 | 11 | 12 | 13 |
| DISTANCE TO ROLL PAPER SURFACE (INITIAL VALUE) [mm] | Lx0 | – | 30.5 | | | | | | | | | | | | |
| DISTANCE TO ROLL PAPER SURFACE (OBTAINED VALUE) [mm] | Lx | – | 30.5 | 30.6 | 30.7 | 30.8 | 30.9 | 31.0 | 31.1 | 31.2 | 31.3 | 31.4 | 31.5 | 31.6 | 31.7 |
| END DISTANCE (DEFAULT) [mm] | Led | 68.1 | ← | ← | ← | ← | ← | ← | ← | ← | ← | ← | ← | ← | ← |
| PAPER CORE DIAMETER (DEFAULT) [mm] | Ded | 76.2 | ← | ← | ← | ← | ← | ← | ← | ← | ← | ← | ← | ← | ← |
| ROLL PAPER DIAMETER (INITIAL VALUE) [mm] | D0 | – | 151.4 | | | | | | | | | | | | |
| ROLL PAPER DIAMETER (CALCULATED VALUE) [mm] | Dx | – | – | 151.2 | 151.0 | 150.8 | 150.6 | 150.4 | 150.2 | 150.0 | 149.8 | 149.6 | 149.4 | 149.0 | 148.8 |
| ROLL PAPER CHANGE AMOUNT [mm] | ΔL | – | 0 | 0.1 | 0.2 | 0.3 | 0.4 | 0.5 | 0.6 | 0.7 | 0.8 | 0.9 | 1.0 | 1.1 | 1.3 |
| INTER-LABEL LENGTH (DEFAULT) [mm] | L_lbl | 104.6 | | | | | | | | | | | | | |
| INTER-LABEL LENGTH (UPDATED VALUE) [mm] | L_LBLx | – | 105.15 | 105.20 | 105.20 | 105.15 | 105.20 | 105.20 | 105.15 | 105.20 | 105.15 | 105.20 | 105.15 | 105.20 | 105.15 |
| INTER-LABEL LENGTH (AVERAGE VALUE) [mm] | L_LBL | – | 105.150 | 105.175 | 105.183 | 105.175 | 105.180 | 105.183 | 105.179 | 105.181 | 105.178 | 105.180 | 105.177 | 105.179 | 105.177 |
| LABEL SHEET THICKNESS (DEFAULT) [mm] | td | 0.150 | 0.150 | | | | | | | | | | | | |
| LABEL SHEET THICKNESS (CALCULATED VALUE) [mm] | t | – | – | 0.151 | 0.151 | 0.150 | 0.150 | 0.150 | 0.150 | 0.150 | 0.150 | 0.150 | 0.150 | 0.150 | 0.149 |
| NUMBER OF REMAINING LABELS (DEFAULT) [NUMBER OF LABELS] | R_LBLd | 872 | | | | | | | | | | | | | |
| NUMBER OF REMAINING LABELS (CALCULATED VALUE) [NUMBER OF LABELS] | R_LBL | – | 852 | 845 | 843 | 841 | 838 | 836 | 833 | 831 | 828 | 826 | 824 | 821 | 816 |
| DIFFERENCE IN NUMBER OF REMAINING LABELS [NUMBER OF LABELS] | ΔR | – | 0 | 7 | 2 | 2 | 2 | 2 | 2 | 2 | 2 | 2 | 2 | 2 | 2 |
| NUMBER OF PRINTED LABELS [NUMBER OF LABELS] | C_LBL | – | 0 | 3 | 6 | 9 | 15 | 18 | 21 | 24 | 27 | 30 | 33 | 36 | 39 |
| DIFFERENCE IN NUMBER OF PRINTED LABELS [NUMBER OF LABELS] | ΔC | – | 0 | 3 | 3 | 3 | 3 | 3 | 3 | 3 | 3 | 3 | 3 | 3 | 3 |

Fig. 9

[NUMBER OF REMAINING 6-INCH LABELS (REMOVED FOR REPLACEMENT BEFORE ALL LABELS ARE PRINTED/THICKNESS CHANGE/LABEL LENGTH AND INTER-LABEL LENGTH CHANGE)]

| | | SYMBOL | DEFAULT/ USER | AT TIME OF STARTING | DURING PRINTING OPERATION | | | | | | | | | | | |
|---|---|---|---|---|---|---|---|---|---|---|---|---|---|---|---|---|
| NUMBER OF TIMES OF OBTAINMENT | | N | – | 1 | 2 | 3 | 4 | 5 | 6 | 7 | 8 | 9 | 10 | 11 | 12 | 13 |
| DISTANCE TO ROLL PAPER SURFACE (INITIAL VALUE) | [mm] | Lx0 | – | 50.0 | | | | | | | | | | | | |
| DISTANCE TO ROLL PAPER SURFACE (OBTAINED VALUE) | [mm] | Lx | – | 50.0 | 50.1 | 50.2 | 50.3 | 50.4 | 50.5 | 50.6 | 50.7 | 50.8 | 50.9 | 51 | 51.1 | 51.2 |
| END DISTANCE (DEFAULT) | [mm] | Led | 68.1 | ← | ← | ← | ← | ← | ← | ← | ← | ← | ← | ← | ← | ← |
| PAPER CORE DIAMETER (DEFAULT) | [mm] | Ded | 76.2 | ← | ← | ← | ← | ← | ← | ← | ← | ← | ← | ← | ← | ← |
| ROLL PAPER DIAMETER (INITIAL VALUE) | [mm] | D0 | – | 112.4 | | | | | | | | | | | | |
| ROLL PAPER DIAMETER (CALCULATED VALUE) | [mm] | Dx | – | – | 112.2 | 112.0 | 111.8 | 111.6 | 111.4 | 111.2 | 111.0 | 110.8 | 110.6 | 110.4 | 110.2 | 110.0 |
| ROLL PAPER CHANGE AMOUNT | [mm] | ΔL | – | 20 | 0.1 | 0.2 | 0.3 | 0.4 | 0.5 | 0.6 | 0.7 | 0.8 | 0.9 | 1.0 | 1.1 | 1.2 |
| INTER-LABEL LENGTH (DEFAULT) | [mm] | L_lbl | 155.4 | | | | | | | | | | | | | |
| INTER-LABEL LENGTH (UPDATED VALUE) | [mm] | L_LBLx | – | 156.050 | 156.100 | 156.050 | 156.100 | 156.100 | 156.100 | 156.100 | 156.100 | 156.100 | 156.100 | 156.100 | 156.100 | 156.100 |
| INTER-LABEL LENGTH (AVERAGE VALUE) | [mm] | L_LBL | – | 156.050 | 156.075 | 156.067 | 156.080 | 156.083 | 156.083 | 156.086 | 156.088 | 156.089 | 156.090 | 156.091 | 156.092 | 156.092 |
| LABEL SHEET THICKNESS (DEFAULT) | [mm] | td | 0.125 | 0.125 | | | | | | | | | | | | |
| LABEL SHEET THICKNESS (CALCULATED VALUE) | [mm] | t | – | – | 0.113 | 0.151 | 0.135 | 0.129 | 0.125 | 0.123 | 0.112 | 0.112 | 0.112 | 0.112 | 0.112 | 0.112 |
| NUMBER OF REMAINING LABELS (DEFAULT) | [NUMBER OF LABELS] | R_LBLd | 704 | | | | | | | | | | | | | |
| NUMBER OF REMAINING LABELS (CALCULATED VALUE) | [NUMBER OF LABELS] | R_LBL | – | 275 | 302 | 225 | 249 | 260 | 266 | 269 | 292 | 290 | 288 | 286 | 285 | 283 |
| DIFFERENCE IN NUMBER OF REMAINING LABELS | [NUMBER OF LABELS] | ΔR | – | 0 | −27 | 77 | −24 | −11 | −6 | −3 | −23 | 2 | 2 | 2 | 2 | 2 |
| NUMBER OF PRINTED LABELS | [NUMBER OF LABELS] | C_LBL | – | 0 | 2 | 3 | 5 | 7 | 9 | 11 | 14 | 16 | 18 | 20 | 22 | 24 |
| DIFFERENCE IN NUMBER OF PRINTED LABELS | [NUMBER OF LABELS] | ΔC | – | 0 | 2 | 1 | 2 | 2 | 2 | 2 | 3 | 2 | 2 | 2 | 2 | 2 |

Fig. 10

PRINTING APPARATUS FOR PRINTING ON LABELS ON ROLL PAPER AND METHOD FOR DETECTING NUMBER OF REMAINING LABELS ON ROLL PAPER

BACKGROUND

1. Technical Field

The invention relates to a printing apparatus for printing on labels on roll paper and a method for detecting the number of remaining labels on roll paper.

2. Related Art

JP-A-2013-212622 discloses a printing apparatus detecting a remaining amount of a rolled sheet with peelable labels attached to the sheet (hereinafter referred to as a "label sheet"), and calculating and displaying the number of remaining printable labels based on the detected remaining amount of sheet.

In the related art, calculation of the number of remaining printable labels (hereinafter also referred to as "the number of remaining labels") needs a known thickness of the label sheet and previous inputting of the thickness of the label sheet to the printing apparatus. However, users utilize various types of sheets, and it is difficult to previously associate the types of sheets with thicknesses and register this association in the printing apparatus. Furthermore, it is cumbersome for users to input the type and thickness of the sheet for each printing process. A possible input error or the like may lead to a failure in calculating the number accurately.

SUMMARY

An aspect of the invention provides a printing apparatus that performs printing on labels of roll paper formed by winding a label sheet with the labels peelably attached to the label sheet. The printing apparatus includes a label sheet feed-out unit including a roll shaft and configured to feed the label sheet out from the roll paper held by the roll shaft, a printing unit configured to perform printing on the labels on the label sheet fed out from the label sheet feed-out unit, a distance sensor arranged at a predetermined position with respect to the roll shaft and configured to detect a distance from the position to a cylindrical outer surface of the roll paper held by the roll shaft, a label length detecting unit configured to determine a length between the labels included in the label sheet fed out from the label sheet feed-out unit to the printing unit, a label remaining number detecting unit configured to determine a number of remaining labels included in the roll paper with an outer diameter corresponding to the distance detected by the distance sensor, and a label remaining number notifying unit configured to provide a notification of the number of remaining labels determined by the label remaining number detecting unit. The label remaining number detecting unit is configured to, during a printing operation, determine a thickness of the label sheet from the length between the labels determined while the distance detected by the distance sensor changes from a first distance to a second distance, a number of labels printed, the first distance, and the second distance, and determine, from the length between the labels determined, the thickness of the label sheet determined, and a third distance detected by the distance sensor and greater than or equal to the second distance, the number of remaining labels included in the roll paper having an outer diameter corresponding to the third distance.

BRIEF DESCRIPTION OF THE DRAWINGS

The invention will be described with reference to the accompanying drawings, wherein like numbers reference like elements.

FIG. 9 is an explanatory diagram illustrating an example of results of simulation of label remaining number detection.

FIG. 10 is an explanatory diagram illustrating another example of results of simulation of label remaining number detection.

DESCRIPTION OF EXEMPLARY EMBODIMENTS

A: Exemplary Embodiment

Figure 1:
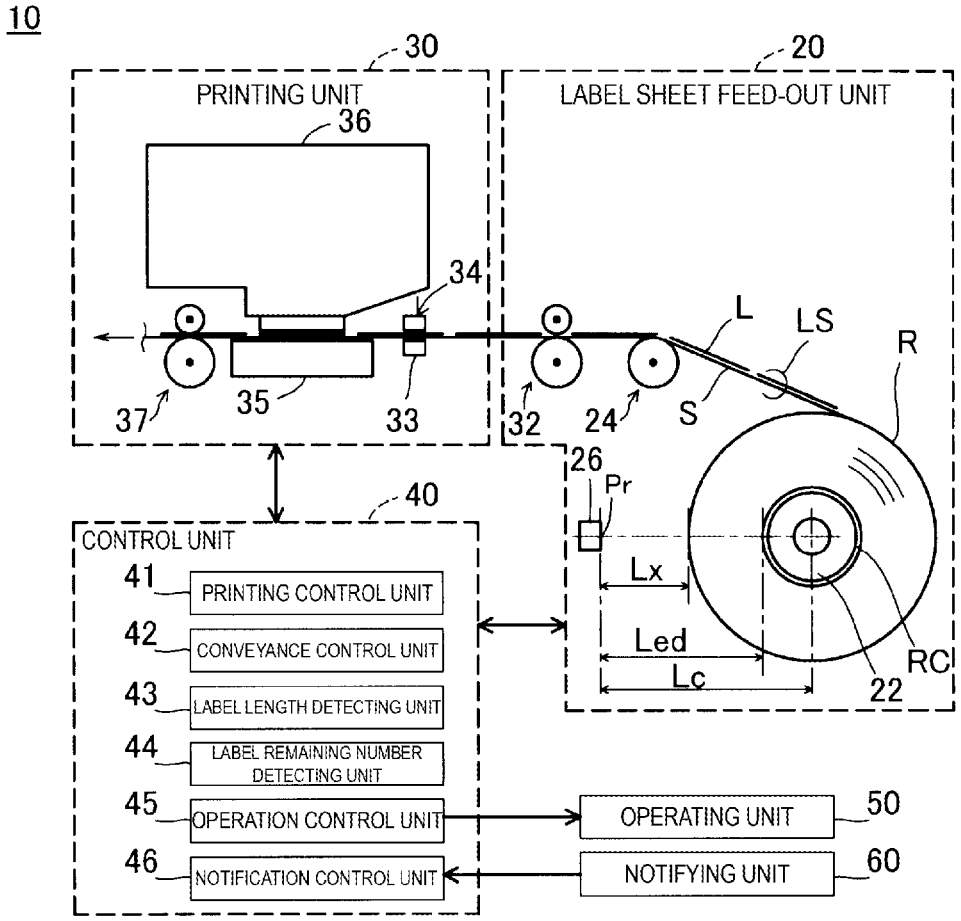
FIG. 1 is a schematic diagram illustrating a configuration of a label printer as an exemplary embodiment.

FIG. 1 is a schematic diagram illustrating a configuration of a label printer 10 as an exemplary embodiment. The label printer 10 as an example of a printing apparatus includes a label sheet feed-out unit 20, a printing unit 30, a control unit 40, an operating unit 50, and a notifying unit 60.

The control unit 40 is configured to control operation of the label sheet feed-out unit 20 and the printing unit 30 in accordance with a user's instruction input via the operating unit 50. The control unit 40 can be configured using an electronic control unit including a CPU, a ROM, a RAM, and various input/output interfaces, for example.

Specifically, the control unit 40 is configured to function as a printing control unit 41, a conveyance control unit 42, a label length detecting unit 43, a label remaining number detecting unit 44, an operation control unit 45, and a notification control unit 46. The printing control unit 41 is configured to control a printing operation in the printing unit 30 described below. The conveyance control unit 42 is configured to control conveyance of a label sheet LS performed by the label sheet feed-out unit 20 and the printing unit 30 described below. The label length detecting unit 43 is configured to detect a position and a length of each of labels L in the label sheet LS and arrangement intervals between the labels L (hereinafter referred to as the "length between the labels" or the "inter-label length") as described below. The label remaining number detecting unit 44 is configured to detect the number of remaining printable labels (the number of remaining labels) included in roll paper R set in the label sheet feed-out unit 20 as described below. The operation control unit 45 is configured to use the operating unit 50 to accept information input by the user. The notification control unit 46 is configured to control the notifying unit 60 to display various pieces of information and alarm messages. For example, the notification control unit 46 is configured to provide display of the number of remaining labels and near end described below and a notification such as activation of a buzzer notifying of the near end.

The label sheet feed-out unit 20 includes the roll paper R set around a roll shaft 22, a conveying roller 32 configured to feed, out toward the printing unit 30, the label sheet LS unrolled from the roll paper R, a conveying roller 24 configured to support the label sheet LS, and a distance sensor 26 configured to detect a distance Lx to a roll surface of the roll paper R. The conveying roller 32 will be described below.

The roll paper R is the label sheet LS that is spirally rolled (a rolled label sheet LS); the label sheet LS is an elongate release sheet S to which labels L are sequentially attached. The labels L are peelable from the release sheet S. The roll shaft 22 is inserted into a cylindrical paper tube RC in the center of the roll paper R to set the roll paper R around the roll shaft 22 such that the roll paper R rotates integrally with the roll shaft 22. The roll shaft 22 with the roll paper R is then set in a support (not illustrated in the drawings) to allow the roll paper R to rotate in conjunction with rotation of the roll shaft 22. Furthermore, the roll shaft 22 connects to a driving device (not illustrated in the drawings), and the label sheet LS rolled into the roll paper R is unrolled in conjunction with rotation of the roll shaft 22 performed by the driving device, or the unrolled label sheet LS is rolled back into the roll paper R. Note that driving of the roll shaft 22 is controlled by the conveyance control unit 42.

The distance sensor 26 is arranged at a position corresponding to a distance Lc from a sensor reference position Pr to a center axis of the roll shaft 22 and corresponding to a distance Led from the sensor reference position Pr to a cylindrical outer surface of the paper tube RC. The distance sensor 26 is configured to detect a distance Lx from the sensor reference position Pr to the cylindrical outer surface of the roll paper R. The distance sensor can be any of various known distance sensors such as an infrared distance sensor. A result of detection by the distance sensor 26 is obtained by the label length detecting unit 43 of the control unit 40 as described below.

The printing unit 30 includes a platen 35 and a print head 36 arranged opposite to the platen 35. A black mark detecting sensor 33 and a gap detecting sensor 34 are arranged on an upstream side of the print head 36 and the platen 35. Furthermore, a conveying roller 37 is arranged on a downstream side of the print head 36 and the platen 35.

The conveying roller 32 provided in the label sheet feed-out unit 20 and the conveying roller 37 provided in the printing unit 30 each include a pair of rollers arranged opposite to each other. One of the rollers of each pair of rollers, e.g., a lower roller, connects to a driving device (not illustrated in the drawings). Each of the conveying rollers 32 and 37 is rotated by the driving device to convey the label sheet LS. Furthermore, the conveying rollers 32 and 37 are configured to control an amount of conveyance of the label sheet LS according to a position of each label L in the label sheet LS detected by the black mark detecting sensor 33 and the gap detecting sensor 34, to position the label L on the platen 35 when the label L is printed. Note that the conveyance control unit 42 is configured to controllably drive the conveying rollers 32 and 37 and the roll shaft 22 such that conveyance of the label sheet LS by the roll shaft 22 is interlocked with conveyance of the label sheet LS by the conveying rollers 32 and 37.

Figure 2:
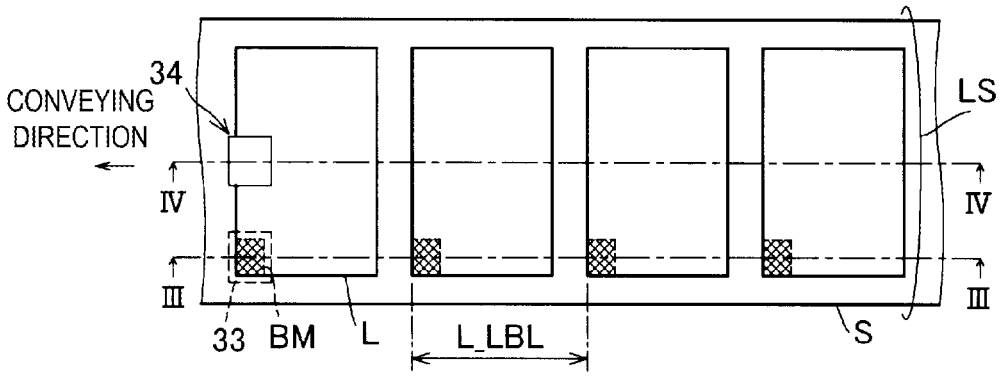
FIG. 2 is a schematic plan view of a label sheet as seen from a side of the label sheet to which labels are attached.
Figure 3:
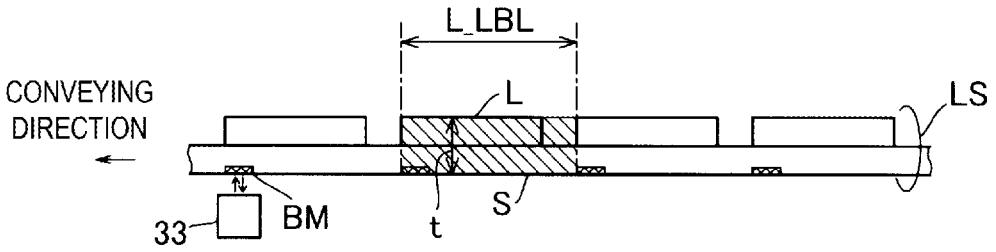
FIG. 3 is a schematic cross-sectional view taken along line in FIG. 2.
Figure 4:
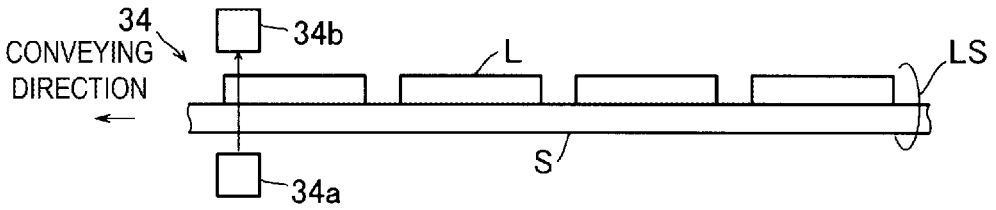
FIG. 4 is a schematic cross-sectional view taken along line IV-IV in FIG. 2.

FIG. 2 is a schematic plan view of the label sheet LS as seen from a side of the label sheet LS to which labels L are attached. FIG. 3 is a schematic cross-sectional view taken along line in FIG. 2. FIG. 4 is a schematic cross-sectional view taken along line IV-IV in FIG. 2.

As illustrated in FIG. 3, the label sheet LS is an elongate release sheet S to which the labels L are sequentially attached, and regular intervals (gaps) are formed between the labels L. Furthermore, the label sheet LS has a thickness t. As illustrated in FIG. 2 and FIG. 3, a surface of the release sheet S opposite to a surface to which the labels L are attached is provided with black marks BM indicative of positions where the respective labels L are attached. In this example, each of the black marks BM is provided at the position of a left corner of a front side, in a conveying direction, of the label L.

As illustrated in FIG. 3, the black mark detecting sensor 33 is arranged at a position where the black marks BM are to pass when the label sheet LS moves along the conveying direction. The black mark detecting sensor 33 includes a light emitting element and a light receiving element and can detect a change in reflected light depending on the presence or absence of the black mark BM. Furthermore, as illustrated in FIG. 4, the gap detecting sensor 34 is arranged at any position in a direction orthogonal to the conveying direction with respect to the labels L, in this example, a center position. As illustrated in FIG. 4, the gap detecting sensor 34 also includes a light emitting unit 34*a* arranged on the release sheet S side and a light receiving unit 34*b* arranged on the label L side to detect a change in transmitted light depending on the gap between the labels L.

The label length detecting unit 43 in FIG. 1 can use results of detection by the black mark detecting sensor 33 and the gap detecting sensor 34 and a conveying speed for the label sheet LS to detect the position and length of each label L and the length between the labels (inter-label length). For example, the label length detecting unit 43 can detect a leading end position of the Nth label L and a leading end position of the N+1th label L from a detected position of the black mark BM and can also detect the length between the labels (inter-label length L_LBL (see FIG. 2 and FIG. 3)) by using the duration between detection of the leading end position of the Nth label L and detection of the leading end position of the N+1th label L and the conveying speed for the label sheet LS. The label length detecting unit 43 can also detect a trailing end position of the Nth label L and a trailing end position of the N+1th label L from the detected position of the gap and can detect the length between the labels (inter-label length L_LBL) by using the duration between detection of the leading end position and detection of the trailing end position, the duration between detection of the trailing end position of the Nth label and detection of the trailing end position of the N+1th label L, and the conveying speed for the label sheet LS. In a case where the black marks BM indicative of the positions to which the labels L are attached are provided on the label sheet LS, the black mark detecting sensor 33 can be used to detect the length between the labels. In a case where no black marks BM indicative of the positions to which the labels L are attached are provided on the label sheet LS and gaps are formed between the labels L, the gap detecting sensor 34 can be used to detect the length between the labels.

Figure 5:
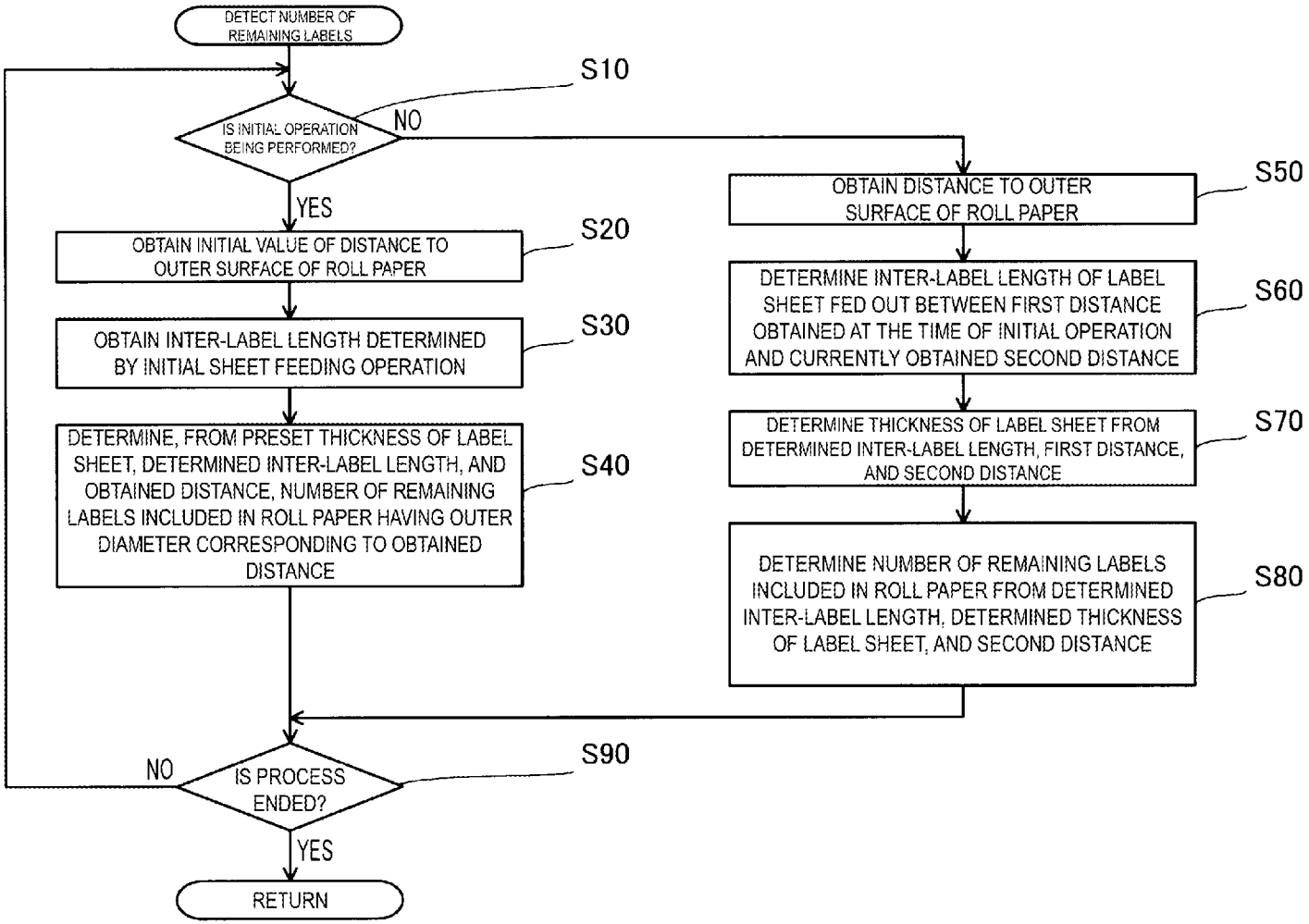
FIG. 5 is an explanatory diagram illustrating a flow of label remaining number detection by a label remaining number detecting unit.

FIG. 5 is an explanatory diagram illustrating a flow of label remaining number detection by the label remaining number detecting unit 44. The label remaining number detecting unit 44 can detect the number of remaining labels included in the roll paper R as described below.

The label remaining number detecting unit 44 first determines in step S10 whether an operation being performed by the label printer 10 is an initial operation performed during starting or resetting. The label remaining number detecting unit 44 performs steps S20 to S40 in a case where the operation being performed by the label printer 10 is the initial operation, and performs steps S50 to S80 in a case where the operation being performed by the label printer 10 is not the initial operation. In step S90, the label remaining number detecting unit 44 then repeats steps S50 to S80 until the process is determined to be ended based on power-off or the like except in a case where the initial operation is performed as a result of resetting or the like.

Steps S20 to S40 performed during the initial operation will be described below. During the initial operation, the label remaining number detecting unit 44 first obtains, in step S20, an initial value Lx0 of the distance Lx from the sensor reference position Pr of the distance sensor 26 (FIG. 1) to the outer surface of the roll paper R. Specifically, the label remaining number detecting unit 44 converts a signal output from the distance sensor 26 into a distance to obtain the initial value Lx0.

The label remaining number detecting unit 44 then obtains, in step S30, the inter-label length L_LBL determined when the label length detecting unit 43 detects the position of the label L, based on a given sheet feeding operation and a given sheet feeding-back operation performed by the conveyance control unit 42 (FIG. 1).

In step S40, the label remaining number detecting unit 44 determines, from a preset thickness td of the label sheet LS, the determined inter-label length L_LBL, and the obtained initial value Lx0 of the distance Lx, the number of remaining labels R_LBL on the roll paper R with an outer diameter D0 corresponding to the obtained initial value Lx0 of the distance Lx. The preset thickness td of the label sheet LS is a default set value or a set value input by the user. Specifically, the number of remaining labels R_LBL on the roll paper R corresponding to the obtained initial value Lx0 of the distance Lx can be determined as described below.

Figure 6:
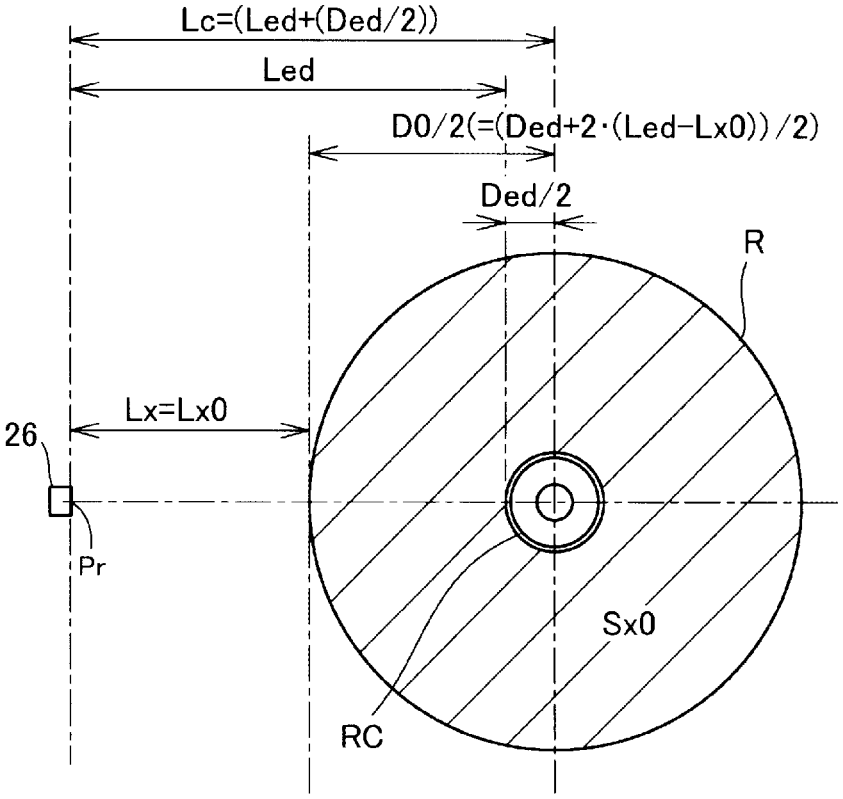
FIG. 6 is an explanatory diagram illustrating how the number of remaining labels is determined when roll paper has an outer diameter corresponding to an initial value of a distance to an outer surface of the roll paper.

FIG. 6 is an explanatory diagram illustrating how the number of remaining labels R_LBL is determined when the distance Lx to the outer surface of the roll paper R is the initial value Lx0 and the outer diameter of the roll paper R is the outer diameter D0 corresponding to the initial value Lx0. An area Sx0 of a side surface (hatched area) of the roll paper R from the cylindrical outer surface of the paper tube RC to the cylindrical outer surface of the roll paper R is expressed by two equations below.

The area Sx0 is expressed by Equation (1) below based on an equation for determining the area of a circle, Equation (1) using the outer diameter D0 of the roll paper R corresponding to the initial value Lx0 and an outer diameter Ded of the paper tube RC.

$$SX0=\pi\cdot(D0/2)^2-\pi\cdot(DED/2)^2 \quad \text{Equation (1)}$$

Furthermore, the area Sx0 is expressed by Equation (2) using the inter-label length L_LBL, the thickness td of the label, and the number of remaining labels R_LBL. Equation (2) is derived based on the assumption that the area Sx0 is approximate to an aggregate of cross sectional areas (the cross-sectional area is illustrated by a hatched area in FIG. 3) of portions of the label sheet LS each corresponding to a single label (the length of a single label+the gap), the number of the cross sectional areas being equal to the number of remaining labels R_LBL.

$$SX0=L_LBL\cdot TD\cdot R_LBL \quad \text{Equation (2)}$$

The number of remaining labels R_LBL is therefore expressed by Equation (3) derived from Equation (1) and Equation (2).

$$R_LBL=((\pi\cdot(D0/2)^2)-(\pi\cdot(DED/2)^2))/(L_LBL\cdot TD) \quad \text{Equation (3)}$$

Here, the outer diameter D0 of the roll paper R corresponding to the initial value Lx0 is double a value resulting from subtraction of the obtained initial value Lx0 of the distance Lx from the distance Lc from the sensor reference position Pr to the center axis of the roll shaft 22, and the distance Lc is the distance Led from the sensor reference position Pr to the cylindrical outer surface of the paper tube RC plus a radius of the paper tube RC, i.e., ½ of the outer diameter Ded of the paper tube RC. Thus, using this relationship, the outer diameter D0 is expressed by Equation (4) below.

$$D0=DED+2\cdot(LED-LX0) \quad \text{Equation (4)}$$

As described above, the number of remaining labels R_LBL on the roll paper R during the initial operation can be determined from the preset thickness td of the label sheet LS, the determined inter-label length L_LBL, and the obtained initial value Lx0 of the distance Lx, in accordance with Equation (3) and Equation (4).

Steps S50 to S80 will now be described that are performed in a case where the label remaining number detecting unit 44 determines in step S10 in FIG. 5 that the operation being performed by the label printer 10 is not the initial operation. In a case where the operation being performed by the label printer 10 is not the initial operation, the label remaining number detecting unit 44 first obtains, in step S50, the distance Lx from the sensor reference position Pr of the distance sensor 26 (FIG. 1) to the outer surface of the roll paper R.

The label remaining number detecting unit 44 then determines, in step S60, the inter-label length L_LBL of the label sheet LS fed out from the label sheet feed-out unit 20 between the initial value Lx0 of the distance Lx obtained during the initial operation (hereinafter also referred to as the "first distance") and the currently obtained distance Lx (hereinafter also referred to as the "second distance"). Specifically, the inter-label length L_LBL can be determined by sequentially accumulating and averaging the inter-label lengths sequentially detected by the label length detecting unit 43 while the distance changes by ΔL from the first distance Lx0 to the second distance Lx.

The label remaining number detecting unit 44 then determines, in step S70, a thickness t of the label sheet LS from the determined inter-label length L_LBL, the first distance Lx0, and the second distance Lx. Specifically, the thickness t can be determined as described below.

Figure 7:
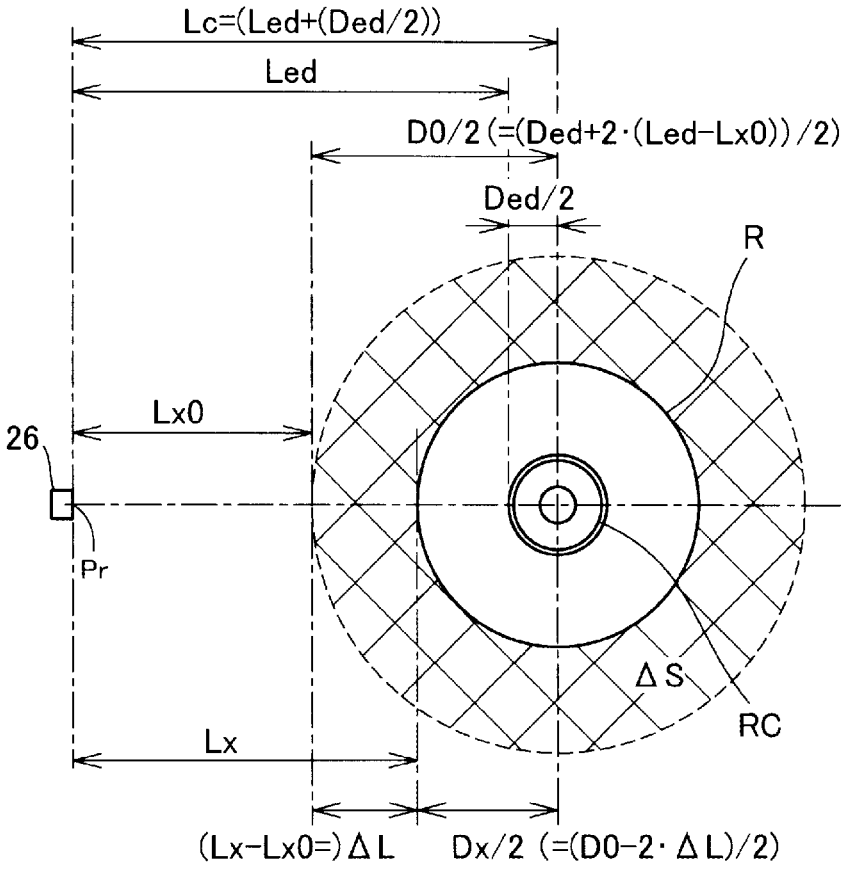
FIG. 7 is an explanatory diagram illustrating how a thickness of the label sheet is determined.

FIG. 7 is an explanatory diagram illustrating how the thickness t of the label sheet LS is determined. In a case where the label sheet LS is fed out from the label sheet feed-out unit 20 and the position of the outer surface of the roll paper R changes by ΔL from the first distance Lx0 to the second distance Lx, the changing area ΔS of the side surface (hatched area) of the roll paper R is expressed by the two equations below.

The changing area ΔS is expressed by Equation (5) below based on the equation for determining the area of a circle, Equation (5) using the outer diameter D0 of the roll paper R corresponding to the first distance Lx0 and the outer diameter Dx of the roll paper R corresponding to the second distance Lx.

$$\Delta S=\pi\cdot(D0/2)^2-\pi\cdot(DX/2)^2 \quad \text{Equation (5)}$$

Furthermore, based on a concept similar to the concept for Equation (2), the changing area ΔS is expressed by Equation (6) using the inter-label length L_LBL, the thickness t of the label sheet LS, and the number of printed labels C_LBL. The number of printed labels C_LBL is the number of labels L actually printed in conjunction of feed-out of the label sheet LS, and is counted by the printing control unit 41 (FIG. 1).

$$\Delta S=L_LBL\cdot T\cdot C_LBL \quad \text{Equation (6)}$$

The thickness t of the label sheet LS is expressed by Equation (7) derived from Equation (5) and Equation (6).

$$T=((\pi\cdot(D0/2)^2)-(\pi\cdot(DX/2)^2))/(L_LBL\cdot C_LBL) \quad \text{Equation (7)}$$

Here, the outer diameter D0 of the roll paper R is expressed by Equation (4). The outer diameter Dx of the roll paper R is double a value resulting from subtraction of the obtained distance (second distance) Lx from the distance Lc from the sensor reference position Pr to the center axis of the roll shaft 22, and the distance Lc is the distance Led from the sensor reference position Pr to the cylindrical outer surface of the paper tube RC plus the radius of the paper tube RC, i.e., ½ of the outer diameter Ded of the paper tube RC. Thus, using this relationship, the outer diameter D0 is expressed by Equation (8).

$$DX=DED+2\cdot(LED-LX) \quad \text{Equation (8)}$$

As described above, the thickness t of the label sheet LS can be determined from the determined inter-label length L_LBL, the first distance Lx0, and the second distance Lx, in accordance with Equation (7) and Equations (4) and (8).

The label remaining number detecting unit 44 then determines, in step S80, the number of remaining labels R_LBL on the roll paper R having the outer diameter Dx corresponding to the obtained distance (second distance) Lx, from the determined inter-label length L_LBL, the determined thickness t of the label sheet LS, and the obtained distance (second distance) Lx. Specifically, the number of remaining labels R_LBL on the roll paper R having the outer diameter Dx corresponding to the obtained distance (second distance) Lx can be determined as described below.

Figure 8:
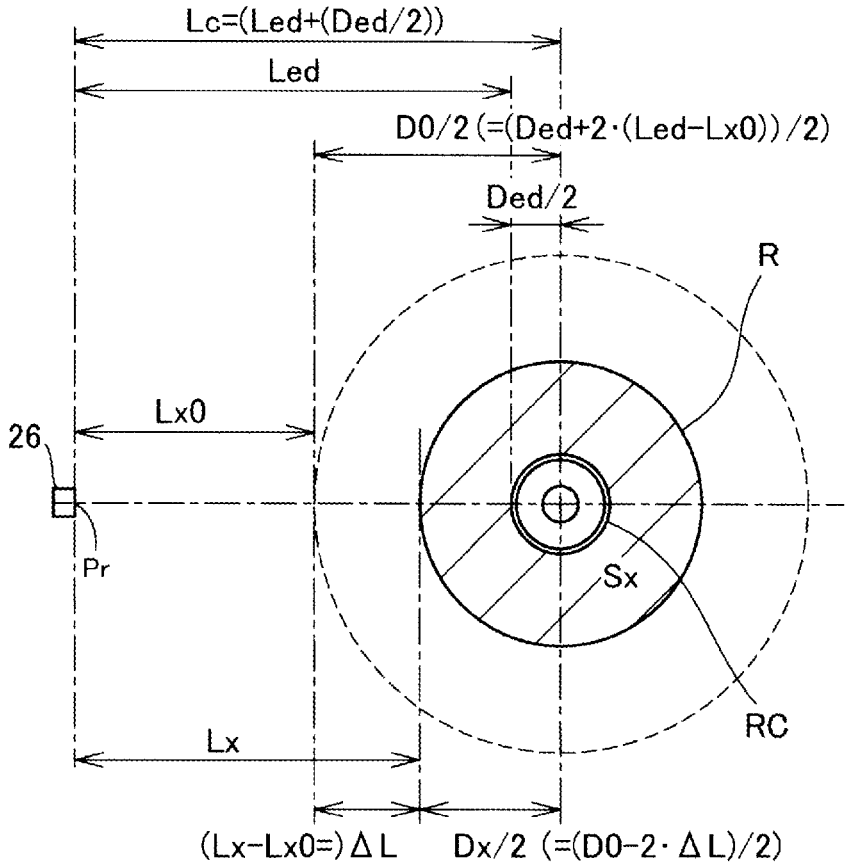
FIG. 8 is an explanatory diagram illustrating how the number of remaining labels is determined when the distance to the outer surface of the roll paper is different from the initial value.

FIG. 8 is an explanatory diagram illustrating how the number of remaining labels R_LBL is determined when the distance to the outer surface of the roll paper R is Lx. The area Sx of the side surface (hatched area) of the roll paper R from the cylindrical outer surface of the paper tube RC to the cylindrical outer surface of the roll paper R is expressed by two equations below.

The area Sx is expressed by Equation (9) based on the equation for determining the area of a circle, Equation (9) using the diameter Dx of the roll paper R and the outer diameter Ded of the paper tube RC.

$$SX=(\pi\cdot(DX/2)^2)-(\pi\cdot(DED/2)^2) \quad \text{Equation (9)}$$

Furthermore, based on a concept similar to the concept for Equation (2) and Equation (6), the area Sx is expressed by Equation (10) using the determined inter-label length L_LBL, the determined thickness t of the label sheet LS, and the number of remaining labels R_LBL.

$$SX=L_LBL\cdot T\cdot R_LBL \quad \text{Equation (10)}$$

The number of remaining labels R_LBL is therefore expressed by Equation (11) below based on Equation (9) and Equation (10).

$$R_LBL=((\pi\cdot(DX/2)^2)-(\pi\cdot(DED/2)^2))/(L_LBL\cdot T) \quad \text{Equation (11)}$$

Here, the diameter Dx of the roll paper R is expressed by Equation (8).

As described above, the number of remaining labels R_LBL on the roll paper R having the outer diameter Dx corresponding to the obtained distance (second distance) Lx can be determined from the determined inter-label length L_LBL, the determined thickness t of the label sheet LS, and the obtained distance (second distance) Lx, in accordance with Equation (11) and Equation (8).

FIG. 9 is an explanatory diagram illustrating an example of results of simulation of label remaining number detection. FIG. 9 illustrates, in an example of new roll paper R, the results of simulation of the number of remaining labels determined according to variation in the obtained distance to the outer surface of the roll paper R (roll paper surface).

Examples of dimensions of the roll paper R are as follows. The label has a length of 4 inches (101.6 mm), the gap is 3 mm, a set value (default value) L_lbl for the inter-label length is 104.6 mm, a set value (default value) Ded for a paper core diameter (the outer diameter of the paper tube RC) is 68.1 mm, and a set value (default value) td for the thickness of the label sheet LS is 0.150 mm. A set value (default value) R_LBLd for the number of remaining labels is 872. Furthermore, a set value (default value) Led for the distance to the paper tube (paper core) RC (end distance) is 68.1 mm.

The number of times of obtainment N indicates the number of times the distance Lx to the roll paper surface has been obtained at regular time intervals using the distance sensor 26 (the ordinal number of the current obtainment).

The process in steps S20 to S40 is performed at the time of a power-on operation corresponding to the initial operation in step S10 in FIG. 5, to determine the number of remaining labels R_LBL before the start of printing as illustrated in FIG. 9. The process in steps S50 to S80 is repeated during a printing operation corresponding to the case where the operation being performed is not the initial operation, to determine the number of remaining labels R_LBL as illustrated in FIG. 9 each time the distance Lx to the roll sheet surface is obtained.

Here, a difference in the number of remaining labels ΔR indicates the difference between the last determined number of remaining labels R_LBL (N−1) and the currently determined number of remaining labels R_LBL (N). Furthermore, a comparison between the difference in the number of remaining labels ΔR and the difference in the number of printed labels ΔC indicates that the difference in the number of remaining labels ΔR involves larger errors than the difference in the number of printed labels ΔC immediately after the start of printing (N=2). However, the difference in the number of remaining labels ΔR subsequently (during and after N=3) varies similarly to the difference in the number of printed labels ΔC.

Furthermore, the number of remaining labels R_LBL determined at the time of starting is 852, which is significantly different from the default number of remaining labels R_LBLd (872). However, the number of remaining labels R_LB at the time of starting is determined to be 856 from the number of remaining labels R_LBL=826 in a stable state during the printing operation, e.g., at the time of N=10, and the number of printed labels C_LBL=30 at this time. Therefore, even before the start of printing, the number of remaining labels R_LBL is determined without substantially large errors.

FIG. 10 is an explanatory diagram illustrating another example of results of simulation of label remaining number detection. FIG. 10 illustrates the results of simulation of the number of remaining labels determined according to variation in the obtained distance to the outer surface of the roll paper R (roll paper surface) in a case where roll paper R that is not new and has been removed for replacement before all the labels are printed is set again, by way of example.

Examples of dimensions of the roll paper R are as follows. The label has a length of 6 inches (152.4 mm), the gap is 3 mm, the set value (default value) L_lbl for the inter-label length is 155.4 mm, the set value (default value) Ded for the paper core diameter (the diameter of the paper tube RC) is 68.1 mm, and the set value (default value) td for the thickness of the label sheet LS is 0.125 mm. The set value (default value) R_LBLd for the number of remaining labels is 704. Furthermore, the set value (default value) Led for the distance to the paper tube (paper core) RC (end distance) is 68.1 mm.

Likewise, the process in steps S20 to S40 is performed at the time of the power-on operation corresponding to the initial operation in step S10 in FIG. 5, to determine the number of remaining labels R_LBL before the start of printing as illustrated in FIG. 10. The process in steps S50 to S80 is repeated during the printing operation corresponding to the case where the operation being performed is not the initial operation, and the number of remaining labels R_LBL is determined as illustrated in FIG. 10 each time the distance Lx to the roll paper surface is obtained.

Here, a comparison between the difference in the number of remaining labels ΔR and the difference in the number of printed labels ΔC indicates that the difference in the number of remaining labels ΔR fluctuates significantly and involves larger errors than the difference in the number of printed labels ΔC during a period from N=2 to N=9. However, the difference in the number of remaining labels ΔR subsequently varies similarly to the difference in the number of printed labels ΔC during and after N=9.

Furthermore, the number of remaining labels R_LBL determined at the time of starting is 275, which is significantly different from the default number of remaining labels R_LBLd (704). This is because the roll paper R is roll paper that has been removed and set again. However, the number of remaining labels R_LB at the time of starting is determined to be 306 from the number of remaining labels R_LBL (288) in a stable state during the printing operation, e.g., at the time of N=10, and the number of printed labels C_LBL (18) at this time. Therefore, during the printing operation, in spite of errors corresponding to approximately several tens of labels, it can be said that the number of remaining labels R_LBL is determined without substantially large errors.

As described above, during the printing operation, the number of remaining labels can be determined from the inter-label length and the thickness of the label sheet determined when the distance to the outer surface of the roll paper is obtained, and from the distance to the outer surface of the roll paper. Furthermore, at the time of the initial operation, although the determined number of remaining labels involves larger errors than the number of remaining labels determined after the start of printing, the approximate number of remaining labels can be determined from the determined inter-label length, the preset thickness of the label sheet, and the distance to the outer surface of the roll paper.

The determined number of remaining labels is displayed on a display screen of the notifying unit 60 by the notification control unit 46. The user can recognize, by checking the displayed number of remaining labels, whether a set number of labels can be printed. In a case where the printing is enabled, the user can comfortably perform any other operation or the like. In a case where the printing is disabled, the user can determine when the paper is to be exhausted to prepare new roll paper or temporarily suspend the printing and replace the roll paper beforehand with roll paper with remaining labels the number of which is sufficient to achieve the printing. Note that the notification control unit 46 and the notifying unit 60 correspond to a "remaining label number notifying unit."

Note that, at N=3 in FIG. 10, the difference in the number of remaining labels ΔR=77 in a case where the number of printed labels C_LBL=3 and the difference in the number of printed labels ΔC=1. In contrast, the difference in the number of remaining labels ΔR=2 in a case where the number of printed labels C_LBL=4 and the difference in the number of printed labels ΔC=2. That is, immediately after the start of printing, one more or less printed labels significantly change the determined number of remaining labels. Therefore, display of the determined number of remaining labels is preferably updated after a certain number of labels are printed to allow the number of remaining labels to be somewhat stably determined. For example, the display of the number of remaining labels is preferably updated after approximately 10 to 20 labels are printed.

As described above, in the exemplary embodiment, the start of printing allows the number of remaining labels included in the roll paper to be accurately determined from the actually determined length between the labels and the actually determined thickness of the label sheet without any need to preset the thickness of the label sheet. This enables an accurate check of whether a needed number of labels can be printed. Furthermore, at the time of the initial operation, the number of remaining labels included in the roll paper is recognized from the preset thickness of the label sheet and the determined length between the labels. This allows, after the initial operation and before the start of printing, a check of whether printing of a needed number of labels can be substantially achieved.

B. Other Exemplary Embodiments

The invention is not limited to the examples and the exemplary embodiment as described above, and can be implemented in various aspects, without departing from the scope of the disclosure. For example, the examples and the exemplary embodiment can be modified as follows.

(1) In the description of the exemplary embodiment, the number of remaining labels at the second distance is determined by using the inter-label length and the thickness of the label sheet determined while the distance changes from the distance obtained at the time of the initial operation (first distance) to the currently obtained distance (second distance), by way of example. However, the invention is not limited to this, and the inter-label length and the thickness of the label sheet determined as described above may be used to determine the number of remaining labels at, instead of the currently obtained second distance, a distance (hereinafter referred to as the "third distance") obtained during the next or subsequent process and which is longer than the second distance. Even in such an aspect, the start of printing allows the number of remaining labels included in the roll paper to be accurately determined from the actually determined length between the labels and the actually determined thickness of the label sheet without any need to preset the thickness of the label sheet. This enables an accurate check of whether a needed number of labels can be printed.

(2) In the description of the exemplary embodiment, the determined number of remaining labels is displayed on the display screen of the notifying unit 60 by the notification control unit 46. However, the invention is not limited to this. For example, in a case where the number of remaining labels arrives at a predetermined value (also referred to as "near end"), a visual notification may be provided such as display on the screen indicating the arrival or lighting of a warning lamp, or an auditory notification such as a warning buzzer may be provided. According to such an aspect, the user can be notified that the number of remaining printable labels is to arrive at a value at which the roll paper needs to be replaced.

(3) In the description of the exemplary embodiment, at the time of the initial operation, the determined inter-label length is obtained by performing the given feeding operation and the feeding-back operation. However, in a case where the inter-label length fails to be determined by the method in the Exemplary Embodiment, the preset inter-label length may be used to determine the number of remaining labels as in the case of the thickness of the label sheet. This also allows determination of the number of remaining labels included in the roll paper, and whether printing of a needed number of labels can be substantially achieved after the initial operation and before the start of printing can be checked.

C. Other Aspects

The invention is not limited to the exemplary embodiment, the examples, and the modified examples described above, and can be realized in various configurations without departing from the gist of the invention. For example, the invention can be implemented in the following aspects. Technical features in the above-described exemplary embodiment corresponding to the technical features in the aspects described below can appropriately be replaced or combined to address some or all of the above-described issues or to achieve some or all of the above-described effects. Additionally, when the technical features are not described herein as essential technical features, such technical features may be deleted appropriately.

(1) An aspect of the invention provides a printing apparatus that performs printing on labels of roll paper formed by winding a label sheet with the labels peelably attached to the label sheet. The printing apparatus includes a label sheet feed-out unit including a roll shaft and configured to feed the label sheet out from the roll paper held by the roll shaft, a printing unit configured to perform printing on the labels on the label sheet fed out from the label sheet feed-out unit, a distance sensor arranged at a predetermined position with respect to the roll shaft and configured to detect a distance from the position to a cylindrical outer surface of the roll paper held by the roll shaft, a label length detecting unit configured to determine a length between the labels included in the label sheet fed out from the label sheet feed-out unit to the printing unit, a label remaining number detecting unit configured to determine a number of remaining labels included in the roll paper with an outer diameter corresponding to the distance detected by the distance sensor, and a label remaining number notifying unit configured to provide a notification of the number of remaining labels determined by the label remaining number detecting unit. The label remaining number detecting unit is configured to, during a printing operation, determine a thickness of the label sheet from the length between the labels determined while the distance detected by the distance sensor changes from a first distance to a second distance, a number of labels printed, the first distance, and the second distance, and determine, from the length between the labels determined, the thickness of the label sheet determined, and a third distance detected by the distance sensor and greater than or equal to the second distance, the number of remaining labels included in the roll paper having an outer diameter corresponding to the third distance.

According to the printing apparatus in this aspect, the start of printing allows the number of remaining labels included in the roll paper to be accurately determined from the actually determined length between the labels and the actually determined thickness of the label sheet without any need to preset the thickness of the label sheet. This enables an accurate check of whether a needed number of labels can be printed.

(2) In the printing apparatus in the above-described aspect, during an initial operation, from a preset thickness of the label sheet, a preset length between the labels or the length between the labels determined by the label length detecting unit, and a distance detected by the distance sensor, the number of remaining labels included in the roll paper with the outer diameter corresponding to the distance may be determined.

According to the printing apparatus in this aspect, during the initial operation, the number of remaining labels included in the roll paper is determined using the preset thickness of the label sheet and the preset length between the labels or the length between the labels determined by the label length detecting unit. This enables, after the initial operation and before the printing operation, a check of whether printing of a needed number of labels can be substantially achieved.

(3) In the printing apparatus in the above-described aspect, the label remaining number notifying unit may be configured to provide a notification indicating that the number of remaining printable labels has reached a predetermined value.

According to the printing apparatus in this aspect, the user can be notified that the number of remaining printable labels is to arrive at a value at which the roll paper needs to be replaced.

(4) In the printing operation in the above-described aspect, the third distance may be equal to the second distance, and when the second distance is detected as the third distance, the number of remaining labels included in the roll paper with the outer diameter corresponding to the second distance as the third distance may be determined from the length between the labels determined, the thickness of the label sheet determined, and the second distance as the third distance.

According to the printing apparatus in this aspect, when the distance changes from the first distance to the second distance, the number of remaining labels included in the roll paper having an outer diameter corresponding to the second distance can be determined from the determined length between the labels, the determined thickness of the label sheet, the first distance, and the second distance.

(5) Another aspect of the invention provides a method for detecting a number of remaining labels included in roll paper held by a roll shaft when a label sheet is fed out for use from the roll paper held by the roll shaft formed by winding the label sheet with labels peelably attached to the label sheet. The method includes the steps of (a) detecting a distance from a predetermined position to a cylindrical outer surface of the roll paper held by the roll shaft, (b) determining a length between the labels included in the fed-out label sheet, and (c) determining the number of remaining labels included in the roll paper with an outer diameter corresponding to the detected distance. The step (c), at the time of use, determines a thickness of the label sheet from the length between the labels determined while the detected distance changes from a first distance to a second distance, a number of labels used, the first distance, and the second distance, and determines, from the determined length between the labels, the determined thickness of the label sheet, and a third distance that is a detected distance and that is greater than or equal to the second distance, the number of remaining labels included in the roll paper with an outer diameter corresponding to the third distance.

According to the method for detecting the number of remaining labels in this aspect, the start of use allows the number of remaining labels included in the roll paper to be accurately recognized from the actually determined length between the labels and the actually determined thickness of the label sheet without any need to preset the thickness of the label sheet. This enables an accurate check of whether a needed number of labels can be printed.

The invention can be realized in various aspects other than the printing apparatus and the method for detecting the number of remaining labels. For example, the invention can be achieved in aspects such as a control method for the printing apparatus and a control device for the printing apparatus, a label remaining number detecting device and a control method for the label remaining number detecting device, a computer program for realizing the control method for the printing apparatus and the control method for the label remaining number detecting device, and a non-transitory recording medium in which the computer program is recorded.

This application claims priority under 35 U.S.C. § 119 to Japanese Patent Application No. 2018-050569, filed Mar. 19 2018. The entire disclosure of Japanese Patent Application No. 2018-050569 is hereby incorporated herein by reference.

What is claimed is:

1. A printing apparatus for performing printing on labels of roll paper formed by winding a label sheet with the labels peelably attached to the label sheet, the printing apparatus comprising:

a label sheet feed-out unit including a roll shaft and configured to feed the label sheet out from the roll paper held by the roll shaft;

a printing unit configured to perform printing on the labels on the label sheet fed out from the label sheet feed-out unit;

a distance sensor arranged at a predetermined position with respect to the roll shaft and configured to detect a distance from the position to a cylindrical outer surface of the roll paper held by the roll shaft;

a label length detecting unit configured to determine a length between the labels included in the label sheet fed out from the label sheet feed-out unit to the printing unit;

a label remaining number detecting unit configured to determine a number of remaining labels included in the roll paper with an outer diameter corresponding to the distance detected by the distance sensor; and a label remaining number notifying unit configured to provide a notification of the number of remaining labels determined by the label remaining number detecting unit, wherein the label remaining number detecting unit is configured to, during a printing operation, determine a thickness of the label sheet from the length between the labels determined while the distance detected by the distance sensor changes from a first distance to a second distance, a number of the labels printed, the first distance and the second distance, and determine, from the length between the labels determined, the thickness of the label sheet determined, and a third distance detected by the distance sensor and greater than or equal to the second distance, the number of remaining labels included in the roll paper having an outer diameter corresponding to the third distance.

2. The printing apparatus according to claim 1, wherein during an initial operation, from a preset thickness of the label sheet, a preset length between the labels or the length between the labels determined by the label length detecting unit, and a distance detected by the distance sensor, the number of remaining labels included in the roll paper with the outer diameter corresponding to the distance is determined.

3. The printing apparatus according to claim 1, wherein the label remaining number notifying unit is configured to provide a notification indicating that the number of remaining printable labels has reached a predetermined value.

4. The printing apparatus according to claim 1, wherein the third distance is equal to the second distance, and when the second distance is detected as the third distance, the number of remaining labels included in the roll paper with the outer diameter corresponding to the second distance as the third distance is determined from the length between the labels determined, the thickness of the label sheet determined, and the second distance as the third distance.

5. A method for detecting a number of remaining labels included in roll paper held by a roll shaft when a label sheet is fed out for use from the roll paper held by the roll shaft formed by winding the label sheet with labels peelably attached to the label sheet, the method comprising:

(a) detecting a distance from a predetermined position to a cylindrical outer surface of the roll paper held by the roll shaft;

(b) determining a length between the labels included in the fed-out label sheet; and (c) determining the number of remaining labels included in the roll paper with an outer diameter corresponding to the detected distance, wherein the process (c) includes, after start of use, determining a thickness of the label sheet from the length between the labels determined while the detected distance changes from a first distance to a second distance, a number of the labels used, the first distance, and the second distance; and determining, from the determined length between the labels, the determined thickness of the label sheet, and a third distance that is a detected distance and that is greater than or equal to the second distance, the number of remaining labels included in the roll paper with an outer diameter corresponding to the third distance.

* * * * *